US005970526A

United States Patent [19]

Weathers

[11] Patent Number: 5,970,526

[45] Date of Patent: Oct. 26, 1999

[54] ADJUSTABLE MULTI-PART BELT

[76] Inventor: Jessie Weathers, 163 E. 122nd Pl., Chicago, Ill. 60628

[21] Appl. No.: 09/193,815

[22] Filed: Nov. 17, 1998

[51] Int. Cl.[6] ..... A41F 9/00; A44B 18/00

[52] U.S. Cl. ..... 2/321; 2/311; 2/338; 2/920; 24/442

[58] Field of Search ..... 2/321, 311, 312, 2/317, 318, 319, 322, 323, 338, 336, 170, 171, DIG. 11, 920, 61, 239, 22, 16; 602/19, 36; 128/96.1, 99.1, 100.1; 24/306, 442

[56] References Cited

U.S. PATENT DOCUMENTS

| | | | |
|---|---|---|---|
| 3,038,166 | 6/1962 | Tobias . | |
| 4,463,455 | 8/1984 | Kirk . | |
| 4,501,027 | 2/1985 | Olsson | 2/321 |
| 4,715,364 | 12/1987 | Noguchi . | |
| 4,864,698 | 9/1989 | Brame | 24/442 |
| 4,999,853 | 3/1991 | Tanner | 2/321 |
| 5,289,619 | 3/1994 | Pileggi | 24/306 |
| 5,316,022 | 5/1994 | Schiek | 128/876 |
| 5,464,136 | 11/1995 | Eddy | 224/252 |
| 5,489,260 | 2/1996 | Striano . | |
| 5,638,550 | 6/1997 | Tretheway | 24/16 R |
| 5,762,619 | 6/1998 | Simon | 602/19 |
| 5,774,898 | 7/1998 | Malpee | 2/239 |
| 5,806,087 | 9/1998 | Grotefend | 2/312 |

FOREIGN PATENT DOCUMENTS 2280094 1/1995 United Kingdom .

*Primary Examiner*—John J. Calvert
*Assistant Examiner*—Tejash Patel
*Attorney, Agent, or Firm*—Goldstein & Canino

[57] ABSTRACT

An adjustable multi-part belt including an elongated central portion having long opposed side edges and short opposed end edges. The central portion has an inner surface and an outer surface. An elongated first side portion is provided having long opposed side edges and short opposed end edges. The first side portion has an inner surface and an outer surface. A first opposed end edge is adjustably coupled with the central portion at a selected position thereon. A second opposed end edge of the first side portion has a male buckle extending outwardly therefrom. An elongated second side portion is provided having long opposed side edges and short opposed end edges. The second side portion has an inner surface and an outer surface. The first opposed end edge is adjustably coupled with the central portion at a selected position thereon opposed from the first side portion. A second opposed end edge of the second side portion has a female buckle extending outwardly therefrom for coupling with the male buckle of the first side portion to selectively engage the belt around a waist of a wearer.

6 Claims, 1 Drawing Sheet

ADJUSTABLE MULTI-PART BELT

BACKGROUND OF THE INVENTION

1. Field of the Invention

The present invention relates to an adjustable multi-part belt and more particularly pertains to extending in length to accommodate an expanding waist line with an adjustable multi-part belt.

2. Description of the Prior Art

The use of belts is known in the prior art. More specifically, belts heretofore devised and utilized for the purpose of providing means for expansion are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,038,166 to Tobias; U.S. Pat. No. 5,489,260 to Striano; U.S. Pat. No. 4,463,445 to Kirk; and U.S. Pat. No. 4,715,364 to Noguchi.

While these devices fulfill their respective, particular objective and requirements, the aforementioned patents do not describe an adjustable multi-part belt for extending in length to accommodate an expanding waist line.

In this respect, the adjustable multi-part belt according to the present invention substantially departs from the conventional concepts and designs of the prior art, and in doing so provides an apparatus primarily developed for the purpose of extending in length to accommodate an expanding waist line.

Therefore, it can be appreciated that there exists a continuing need for new and improved adjustable multi-part belt which can be used for extending in length to accommodate an expanding waist line. In this regard, the present invention substantially fulfills this need.

SUMMARY OF THE INVENTION

In the view of the foregoing disadvantages inherent in the known types of belts now present in the prior art, the present invention provides an improved adjustable multi-part belt. As such, the general purpose of the present invention, which will be described subsequently in greater detail, is to provide a new and improved adjustable multi-part belt and method which has all the advantages of the prior art and none of the disadvantages.

To attain this, the present invention essentially comprises an elongated central portion having long opposed side edges and short opposed end edges. The central portion has an inner surface and an outer surface. The central portion has a length between seven and fifty inches. The inner surface has a layer of hook and loop material disposed thereon. Each of the long opposed side edges have a pair of looped bands extending therebetween adjacent to the short opposed end edges. An elongated first side portion is provided having long opposed side edges and short opposed end edges. The first side portion has an inner surface and an outer surface. The first side portion has a length between three and twenty-five inches. The outer surface has a section of hook and loop material disposed thereon inwardly of one of a first opposed end edge thereof. The first opposed end edge is received through one of the looped bands of the central portion with the section of hook and loop material mating with the hook and loop material at a selected position thereon. A second opposed end edge of the first side portion has a male buckle extending outwardly therefrom. An elongated second side portion is provided having long opposed side edges and short opposed end edges. The second side portion has an inner surface and an outer surface. The second side portion has a length between three and twenty-five inches. The outer surface has a section of hook and loop material disposed thereon inwardly of a first opposed end edge thereof. The first opposed end edge is received through one of the looped bands of the central portion with the section of hook and loop material mating with hook and loop material at a selected position thereon. A second opposed end edge of the second side portion has a female buckle extending outwardly therefrom for coupling with the male buckle of the first side portion to selectively engage the belt around a waist of a wearer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable multi-part belt which has all the advantages of the prior art belts and none of the disadvantages.

It is another object of the present invention to provide a new and improved adjustable multi-part belt which may be easily and efficiently manufactured and marketed.

It is a further object of the present invention to provide a new and improved adjustable multi-part belt which is of durable and reliable construction.

An even further object of the present invention is to provide a new and improved adjustable multi-part belt which is susceptible of a low cost of manufacture with regard to both materials and labor, and which accordingly is then susceptible of low prices of sale to the consuming public, thereby making such an adjustable multi-part belt economically available to the buying public.

Even still another object of the present invention is to provide a new and improved adjustable multi-part belt for extending in length to accommodate an expanding waist line.

Lastly, it is an object of the present invention to provide a new and improved adjustable multi-part belt including an elongated central portion having long opposed side edges and short opposed end edges. The central portion has an inner surface and an outer surface. An elongated first side portion is provided having long opposed side edges and short opposed end edges. The first side portion has an inner surface and an outer surface. A first opposed end edge is adjustably coupled with the central portion at a selected position thereon. A second opposed end edge of the first side portion has a male buckle extending outwardly therefrom. An elongated second side portion is provided having long opposed side edges and short opposed end edges. The second side portion has an inner surface and an outer surface. The first opposed end edge is adjustably coupled with the central portion at a selected position thereon opposed from the first side portion. A second opposed end edge of the second side portion has a female buckle extending outwardly therefrom for coupling with the male buckle of the first side portion to selectively engage the belt around a waist of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
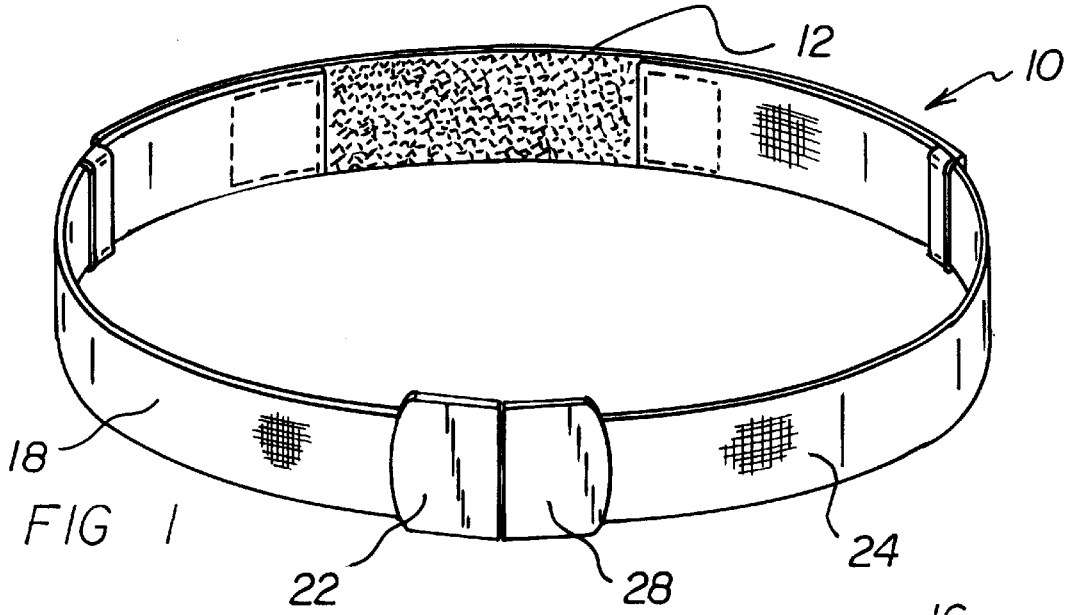
FIG. 1 is a perspective view of the preferred embodiment of the adjustable multi-part belt constructed in accordance with the principles of the present invention.
Figure 2:
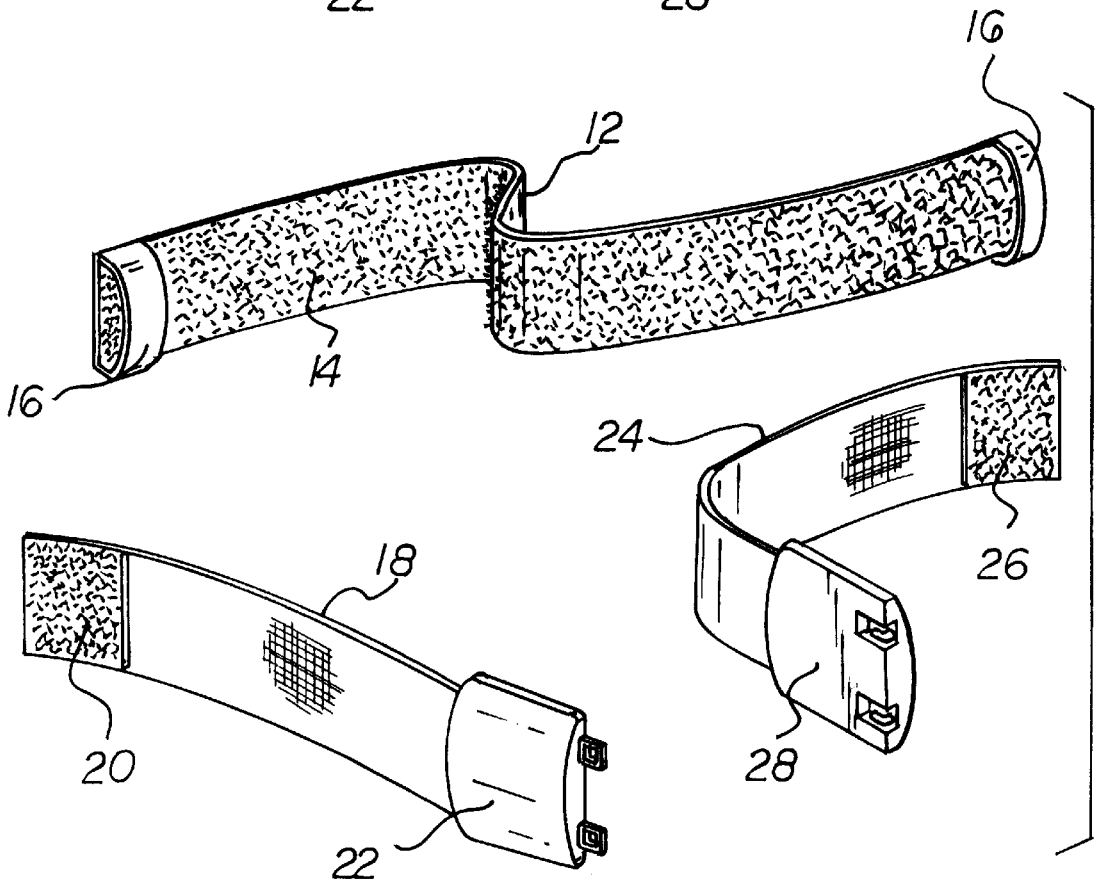
FIG. 2 is an exploded perspective view of the present invention.

With reference now to the drawings, and in particular, to FIGS. 1 and 2 thereof, the preferred embodiment of the new and improved adjustable multi-part belt embodying the principles and concepts of the present invention and generally designated by the reference number 10 will be described.

Specifically, it will be noted in the various Figures that the device relates to a adjustable multi-part belt for extending in length to accommodate an expanding waist line. In its broadest context, the device consists of an elongated central portion, an elongated first side portion, and an elongated second side portion. Such components are individually configured and correlated with respect to each other so as to attain the desired objective.

The elongated central portion 12 has long opposed side edges and short opposed end edges. The central portion 12 has an inner surface and an outer surface. The central portion 12 has a length between seven and fifty inches. The inner surface has a layer of hook and loop material 14 disposed thereon. Each of the long opposed side edges have a pair of looped bands 16 extending therebetween adjacent to the short opposed end edges.

The elongated first side portion 18 has long opposed side edges and short opposed end edges. The first side portion 18 has an inner surface and an outer surface. The first side portion 18 has a length between three and twenty-five inches. The outer surface has a section of hook and loop material 20 disposed thereon inwardly of one of a first opposed end edge thereof. The first opposed end edge is received through one of the looped bands 16 of the central portion 12 with the section of hook and loop material 20 mating with the hook and loop material 14 at a selected position thereon. A second opposed end edge of the first side portion has a male buckle 22 extending outwardly therefrom.

The elongated second side portion 24 has long opposed side edges and short opposed end edges. The second side portion 24 has an inner surface and an outer surface. The second side portion 24 has a length between three and twenty-five inches. The second side portion 24 is preferably the same length as the first side portion 18. The outer surface has a section of hook and loop material 26 disposed thereon inwardly of a first opposed end edge thereof. The first opposed end edge is received through one of the looped bands 16 of the central portion 12 with the section of hook and loop material 26 mating with hook and loop material 14 at a selected position thereon. A second opposed end edge of the second side portion 24 has a female buckle 28 extending outwardly therefrom for coupling with the male buckle 22 of the first side portion 18 to selectively engage the belt 10 around a waist of a wearer.

In use, the present invention will provide a belt 10 that can easily be expanded to accommodate a growing or shrinking waist line. The user simply takes the first and second side portions 18, 24 and inserts them through the looped bands 16 and secures them to the central portion 12 via the hook and loop fasteners. The user can make any small incremental adjustments necessary to conform the belt 10 to their waist in the most comfortable manner. The belt 10 can be made from any selected material known in the belt art.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable multi-part belt for extending in length to accommodate an expanding waist line comprising, in combination:

an elongated central portion having long opposed side edges and short opposed end edges, the central portion having an inner surface and an outer surface, the central portion having a length between seven and fifty inches, the inner surface having a layer of hook or loop material disposed thereon, each of the long opposed side edges having a pair of looped bands extending therebetween adjacent to the short opposed end edges;

an elongated first side portion having long opposed side edges and short opposed end edges, the first side portion having an inner surface and an outer surface, the first side portion having a length between three and twenty-five inches, the outer surface having a complementary section of hook or loop material disposed thereon inwardly of a first opposed end edge thereof, the first opposed end edge being received through one of the looped bands of the central portion with the complementary section of hook or loop material mating with the hook or loop material at a selected position thereon, a second opposed end edge of the first side portion having a male buckle extending outwardly therefrom;

an elongated second side portion having long opposed side edges and short opposed end edges, the second side portion having an inner surface and an outer surface, the second side portion having a length between three and twenty-five inches, the outer surface having a complementary section of hook or loop material disposed thereon inwardly of a first opposed end edge thereof, the first opposed end edge being received through one of the looped bands of the central portion with the complementary section of hook or loop material mating with the hook or loop material at a selected position thereon, a second opposed end edge of the second side portion having a female buckle extending outwardly therefrom for coupling with the male buckle of the first side portion to selectively engage the belt around a waist of a wearer.

2. An adjustable multi-part belt for extending in length to accommodate an expanding waist line comprising, in combination:

an elongated central portion having long opposed side edges and short opposed end edges, the central portion having an inner surface and an outer surface;

an elongated first side portion having long opposed side edges and short opposed end edges, the first side portion having an inner surface and an outer surface, a first opposed end edge adjustably coupling with the central portion at a selected position thereon, a second opposed end edge of the first side portion having a male buckle extending outwardly therefrom;

an elongated second side portion having long opposed side edges and short opposed end edges, the second side portion having an inner surface and an outer surface, a first opposed end edge adjustably coupling with the central portion at a selected position thereon opposed from the first side portion, a second opposed end edge of the second side portion having a female buckle extending outwardly therefrom for coupling with the male buckle of the first side portion to selectively engage the belt around a waist of a wearer.

3. The adjustable multi-part belt as set forth in claim 2 wherein the central portion has a length between seven and fifty inches.

4. The adjustable multi-part belt as set forth in claim 2 wherein the inner surface of the central portion has a layer of hook or loop material disposed thereon for mating with hook or loop patches disposed on the outer surfaces of the first and second side portions.

5. The adjustable multi-part belt as set forth in claim 2 wherein each of the long opposed side edges of the central portion have a pair of looped bands extending therebetween adjacent to the short opposed end edges for receiving the opposed end edges of the first and second side portions therethrough for coupling with the central portion.

6. The adjustable multi-part belt as set forth in claim 2 wherein the first and second side portions each have a length between three and twenty-five inches.

* * * * *